US008746346B2

(12) United States Patent
Voss

(10) Patent No.: US 8,746,346 B2
(45) Date of Patent: Jun. 10, 2014

(54) SUBSEA TREE WORKOVER CONTROL SYSTEM

(75) Inventor: Robert K. Voss, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 646 days.

(21) Appl. No.: 12/980,649

(22) Filed: Dec. 29, 2010

(65) Prior Publication Data

US 2012/0168169 A1 Jul. 5, 2012

(51) Int. Cl.
*E21B 34/04* (2006.01)

(52) U.S. Cl.
USPC ..... 166/344; 166/347; 166/368; 166/373; 405/190

(58) Field of Classification Search
USPC ..... 166/341, 338, 344, 347, 351, 368, 166/373–375; 405/190, 191
See application file for complete search history.

(56) References Cited

U.S. PATENT DOCUMENTS

| | | | | |
|---|---|---|---|---|
| 910,295 | A | 1/1909 | Layne | |
| 2,536,434 | A | 1/1951 | Fewell | |
| 3,166,123 | A | 1/1965 | Watkins | |
| 3,602,301 | A | 8/1971 | James | |
| 3,642,063 | A | 2/1972 | Jergins | |
| 3,921,500 | A | 11/1975 | Silcox | |
| 4,687,014 | A * | 8/1987 | Godal | 137/14 |
| 5,295,547 | A | 3/1994 | Coelho et al. | |
| 5,623,994 | A | 4/1997 | Robinson | |
| 6,102,124 | A * | 8/2000 | Skeels et al. | 166/347 |
| 6,435,279 | B1 * | 8/2002 | Howe et al. | 166/336 |
| 6,536,528 | B1 | 3/2003 | Amin et al. | |
| 6,575,247 | B2 | 6/2003 | Tolman et al. | |
| 6,840,088 | B2 * | 1/2005 | Tucker et al. | 73/49.5 |
| 6,880,640 | B2 | 4/2005 | Barratt et al. | |
| 6,907,326 | B1 | 6/2005 | Kucik | |
| 6,939,082 | B1 * | 9/2005 | Baugh | 405/145 |
| 7,036,596 | B2 * | 5/2006 | Reid | 166/302 |
| 7,165,619 | B2 * | 1/2007 | Fox et al. | 166/343 |

(Continued)

FOREIGN PATENT DOCUMENTS

| | | | |
|---|---|---|---|
| WO | 2008096170 | A1 | 8/2008 |
| WO | 2008100943 | A2 | 8/2008 |
| WO | 2010019675 | A2 | 2/2010 |
| WO | 2011128355 | A2 | 10/2011 |

OTHER PUBLICATIONS

GB Partial Search Report dated Mar. 7, 2012 from corresponding Application No. GB1121857.5.

(Continued)

*Primary Examiner* — Matthew Buck
(74) *Attorney, Agent, or Firm* — Bracewell & Giuliani LLP

(57) ABSTRACT

An electrical and hydraulic configuration on a subsea tree that facilitates the use of an ROV control system to operate the tree during well installations, interventions, and workovers. An SCM at the tree is in communication with a fixed junction plate that receives a production umbilical during normal operation. The ROV can be deployed to disconnect and park the production umbilical during well installations, interventions, and workovers to prevent accidental operation of the SCM or tree. The junction plate is configured to connect with the ROV and thereby establish communication with the hydraulic lines of the SCM. The ROV may carry an umbilical from a vessel to provide electrical and hydraulic service to the SCM during well operations. In addition, the ROV has facilities to repressurize spent control fluid to thereby allow reuse of the control fluid by the SCM.

8 Claims, 2 Drawing Sheets

(56) References Cited

U.S. PATENT DOCUMENTS

| | | | | |
|---|---|---|---|---|
| 7,215,036 | B1 | 5/2007 | Gehring | |
| 7,234,523 | B2 * | 6/2007 | Reid | 166/302 |
| 7,291,936 | B1 | 11/2007 | Robson | |
| 7,341,109 | B1 | 3/2008 | McDowell | |
| 7,650,943 | B2 * | 1/2010 | Baggs | 166/341 |
| 7,926,501 | B2 * | 4/2011 | Springett et al. | 137/14 |
| RE42,358 | E * | 5/2011 | Tucker et al. | 73/49.5 |
| 8,322,427 | B2 * | 12/2012 | Inderberg et al. | 166/336 |
| 8,336,629 | B2 * | 12/2012 | Vaynshteyn et al. | 166/345 |
| 8,376,050 | B2 * | 2/2013 | Cumming et al. | 166/345 |
| 8,430,168 | B2 * | 4/2013 | Goodall et al. | 166/336 |
| 8,464,525 | B2 * | 6/2013 | Springett et al. | 60/398 |
| 2003/0230190 | A1 * | 12/2003 | Douglas | 91/454 |
| 2005/0039923 | A1 * | 2/2005 | Howe et al. | 166/368 |
| 2006/0083624 | A1 * | 4/2006 | Cunningham et al. | 417/53 |
| 2008/0257559 | A1 * | 10/2008 | Grimseth et al. | 166/375 |
| 2009/0038804 | A1 * | 2/2009 | Going, III | 166/335 |
| 2011/0114329 | A1 * | 5/2011 | Emecheta et al. | 166/350 |
| 2011/0253377 | A1 | 10/2011 | Barber et al. | |

OTHER PUBLICATIONS

GB Search Report dated Oct. 12, 2012 from corresponding Application No. GB1121857.5.

* cited by examiner

SUBSEA TREE WORKOVER CONTROL SYSTEM

FIELD OF THE INVENTION

This invention relates in general to subsea trees, and in particular, to facilitating electrical and hydraulic control service to subsea tree via a remotely operated vehicle (ROV) during workover operations.

BACKGROUND OF THE INVENTION

A subsea tree is a device that is used primarily to control the flow of production fluid from a subsea well. In addition, a subsea tree may be used to direct fluid into the subsea well, such as in chemical injection.

Typically, a subsea tree will utilize several valves for controlling the flow of fluids through the subsea tree. Operation of the subsea tree valves may be controlled by a subsea control module (SCM). The SCM may include several solenoid-operated control valves that direct the flow of hydraulic fluid to the subsea tree valves. The control valves in the SCM control various operations of the subsea tree valves. The control valves are supplied with hydraulic fluid and may be controlled by electrical signals from, for example, an umbilical, which may extend from a production tree or a remote platform.

Subsea tree valves may be hydraulically-operated valves. For example, the operator for a hydraulically-operated valve may have a spring that drives the valve toward a closed state. To open the valve, a control valve must be operated to direct hydraulic fluid pressure from a source of pressurized hydraulic fluid to the valve operator to overcome the force of the spring and drive the valve towards the open state. When it is desired to return the subsea valve to its original state, the control valve is positioned so that the source of pressurized hydraulic fluid no longer directs pressurized hydraulic fluid to the valve operator. The hydraulic fluid in the operator is vented to enable the spring to return the valve to its original state.

To facilitate distribution of the hydraulic fluid in the umbilical to the SCM's control valves, the umbilical may be connected to a receptacle on a junction plate located on the subsea tree. The junction plate typically includes a hydraulic distribution line arrangement extending from the receptacle to the SCM's control valves. Where an umbilical also contains an electrical line, the electrical line can be routed from the receptacle to an electrical connection on the SCM.

At times during the life of a well, equipment must be replaced or installed or a well workover or intervention may be required. During these operations, it is key that the operation of the subsea tree be temporarily turned over to a surface workover vessel and that the production mode of operation be locked out to prevent accidental operation by sources other than the vessel when critical equipment or workover operations are underway.

To assure that the vessel has complete control of the subsea tree, an installation/workover control system (IWOCS) is typically utilized. The IWOCS includes its own umbilical that may contain both hydraulic and electrical feeds to control the subsea tree during the installation or workover operations. Typically then, the production umbilical is disconnected from the receptacle on the junction plate and parked on a seabed parking plate. This assures that the production umbilical will not accidentally operate any of the subsea tree components.

Referring to the prior art as illustrated in FIG. 1, with the production umbilical out of the way, the IWOCS umbilical 10 extending from the vessel may then be connected to the receptacle 12 on the junction plate 16. Once connected, the IWOCS umbilical 10 provides hydraulic fluid to the SCM 18 via distribution lines 20. During operation of the subsea valves, the hydraulic fluid is vented to the sea via exhaust discharge 22. Thus, hydraulic fluid must be replenished to the SCM 18 via the umbilical 10. An electrical line (not shown) can further be routed from the junction plate 16 to an electrical connection 24 on the SCM 18 as shown or a separate electrical umbilical may be used.

Another arrangement is where the control fluid power is provided by a dedicated hydraulic power pack on the ROV. In this case, the power pack must contain sufficient fluid to replenish the supply to the tree functions, as there is typically not a dedicated supply line from the surface. The requirement that hydraulic fluid in the distribution lines 20 be replenished via an internal ROV reservoir is impractical due to impact on unit size and weight and will add operational cost for retrieval time to replenish the ROV reservoir. Additionally, the discharge of fluid to the sea is obviously wasteful and may have a detrimental impact on the environment.

A need exists for a technique to solve one or more of the problems described above.

SUMMARY OF THE INVENTION

In an embodiment of the present invention, the tree exhaust line is routed to a production, fixed junction plate and vents to sea outboard of the removable junction plate. An ROV control system may be used to operate an SCM or subsea tree during well installations, interventions, or workovers. The ROV may be deployed from a vessel and flown towards a subsea tree by an operator on the vessel. Once at the tree, the ROV disconnects a production umbilical from the fixed junction plate located at the tree. The ROV may park the production umbilical on a parking plate to ensure that it does not accidentally operate the SCM or the subsea tree during well installation/workover operations. The ROV then connects its flying lead to the fixed junction plate to establish hydraulic communication with a hydraulic skid on the ROV. The hydraulic skid may further be adapted to establish communication with both the hydraulic supply line and the exhaust line of the SCM. In this embodiment, a pump is located on the hydraulic skid as part of a loop that repressurizes the hydraulic fluid fed to the SCM after it is spent.

The ROV-based control system eliminates the capital and installation cost problems associated with the traditional IWOCS system. The plumbing arrangement between the ROV skid, the junction plate, and the SCM allows spent hydraulic fluid to be repressurized and reused in the SCM, further reducing the control fluid discharge to seawater.

DETAILED DESCRIPTION OF THE INVENTION

Figure 1:
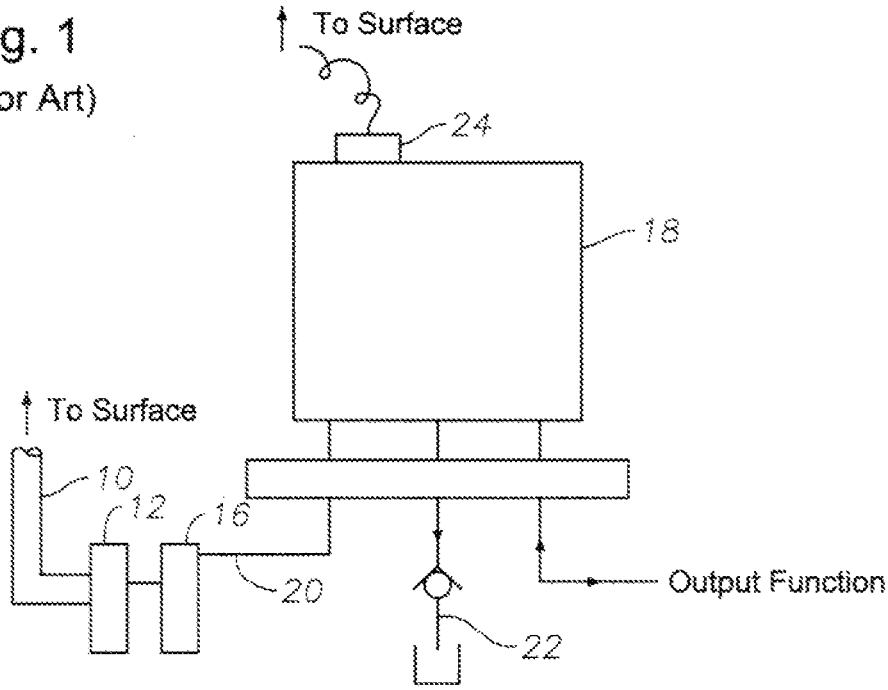
Fig. 1 (Prior Art)
FIG. 1, illustrates a typical umbilical IWOCS connection to a SCM in the prior art.
Figure 2:
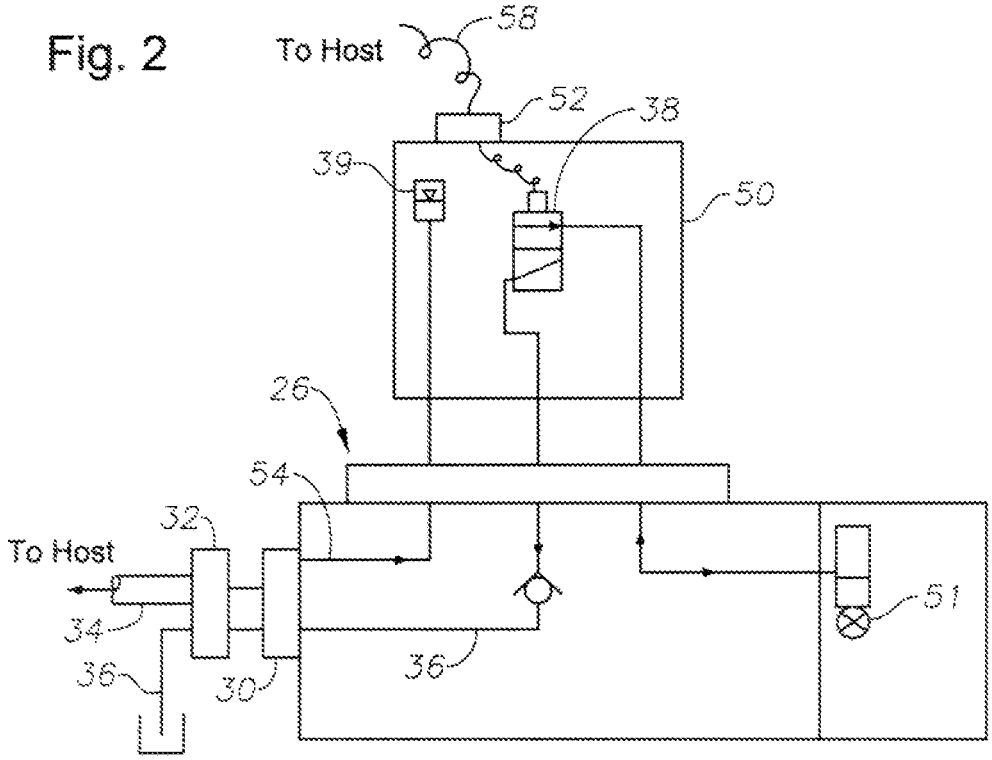
FIG. 2, illustrates an exhaust circuit in production mode, in accordance with an embodiment of the invention.

Referring to FIG. 2, a portion of a subsea tree 26 in accordance with an exemplary embodiment of the present invention is illustrated. In this embodiment, the subsea tree 26 is being operated in a production mode. The subsea tree 26 has a fixed junction 30. A removable junction 32 is secured to the fixed junction 30. The removable junction 12 is provided to couple a production umbilical 34 to the fixed junction 30. The umbilical 34 is configured to provide both hydraulic control fluid and electrical signals during normal production operations in the illustrated embodiment. The production umbilical 34 may extend from a production tree or a remote platform (not shown).

In this embodiment, a tree exhaust line 36 is provided that is routed to reoute hydraulic fluid to sea through the fixed junction 30 and the removable junction 32. The production umbilical 34 connected to the fixed junction 30 via the removable junction 32 provides at least one solenoid operated control valve 38 of a Subsea Control Module (SCM) 50 with hydraulic fluid via SCM hydraulic supply line 54. In this embodiment, the SCM has a small accumulator 39 with pressurized hydraulic fluid. The SCM 50 solenoid operated control valves 38 control hydraulic fluid pressure for opening and closing at least one subsea tree valve 51. In one mode, the solenoid-operated control valves 38 direct pressurized fluid to the subsea valve 51. In another mode, the solenoid-operated control valves 38 vent hydraulic fluid used to operate the subsea tree valves 51 to sea through the fixed junction 30 and removable junction 32. As with all the components described herein, the subsea tree 26 is shown schematically and not scaled relative to other components. An electrical connection 52 on the SCM 50 allows an electrical umbilical 58 to serve the electrical requirements of the SCM 50 and the subsea tree 26.

Figure 3:
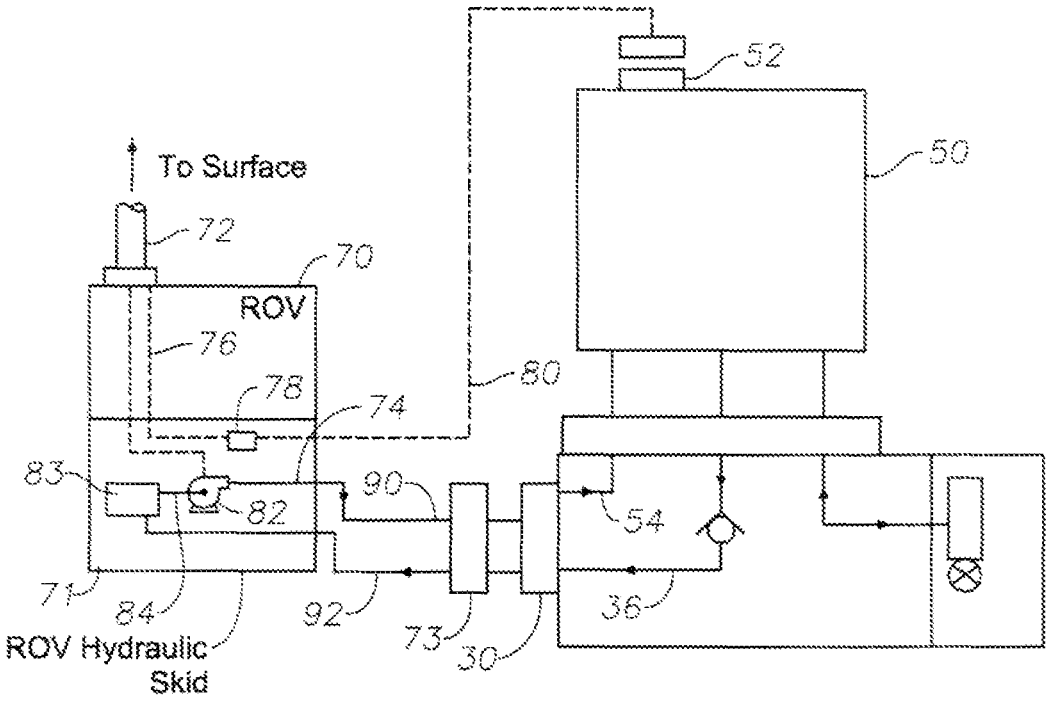
FIG. 3, illustrates an ROV connected to the tree in workover mode with the exhaust fluid recirculated, in accordance with an embodiment of the invention.

Referring to FIG. 3, when a well installation, workover, or intervention is desired, an ROV 70 may be deployed from a vessel (not shown) and navigated towards the subsea tree 26. The ROV 70 is typically controlled by an operator on the vessel. In this embodiment, the ROV 70 carries an ROV umbilical or flying lead 72 from the vessel down to the subsea tree. The ROV 70 has facilities allowing it to disconnect and pickup the production umbilical 34 (FIG. 2) from the fixed junction 30 and park the production umbilical 34 on a seabed parking (not shown) until the installation/workover operations are complete. This assures that the production umbilical 34 (FIG. 2) will not accidentally operate the SCM 50 or subsea tree 26 accidentally during installation/workover operations.

With the production umbilical 34 (FIG. 2) out of the way, the ROV 70 then connects the flying lead 72 to the fixed junction 30. The ROV 70 may comprise a hydraulic skid 71 adapted to interface with the fixed junction 30 to thereby establish hydraulic communication between the ROV 70 and the SCM 50. The hydraulic skid 71 in this embodiment may further comprise a removable junction 73 that interfaces with the fixed junction 30 to establish communication with both the hydraulic supply line 54 and the exhaust line 36 of the SCM 50, which are both routed to the fixed junction 30. An electrical line 76 may also be provided to the ROV 70 via ROV umbilical 72 to provide electrical control signals or power for equipment such as such as valves, lights, pumps, or cameras. The electrical line 76 may connect to an electrical module 78 on the hydraulic skid 71 from where an electrical distribution line 80 may be connected to the electrical connection 52 on the SCM 50. In this embodiment, the connection 73 on the hydraulic skid 71 further establishes communication between internal piping within the skid 71 and the hydraulic supply line 54 and the exhaust line 36 of the SCM 50, to form a closed-loop system. In this embodiment, a pump 82 is located on the hydraulic skid 71 and is connected to the internal piping to form part of the loop. A reservoir 83 may be used at the tee connection formed by lines 92 and line 84 connected to an intake on the pump 82 to facilitate fluid supply in the loop. The pump 82 is used to repressurize the hydraulic fluid fed to the SCM 50 to thereby allow reuse of the control fluid by the SCM 50.

In an example of operation of this installation/workover embodiment, the ROV flying lead 72 provide the ROV 70 with hydraulic fluid and electrical power supplied from a vessel on the surface. The hydraulic fluid will be introduced into a connection hydraulic line 90 via hydraulic line 74 and will be supplied to the SCM 50 via hydraulic supply line 54. Hydraulic fluid vented from the subsea valves 51 is directed via exhaust line 36 from the SCM 50 back to the return line 92. Both lines 90 and 92 are coupled to the fixed junction 30 via removable junction 73. The return line 92 will allow the vented hydraulic fluid to circulate into the ROV skid section 71 for repressurization by the pump 82. The pump 82 discharges the pressurized control fluid into the hydraulic line 90 in the skid 71 and back into the hydraulic supply line 54 for reintroduction to the SCM 50. In operation, the electrical portion of the ROV umbilical 72 further supplies power to the pump 82.

Figure 4:
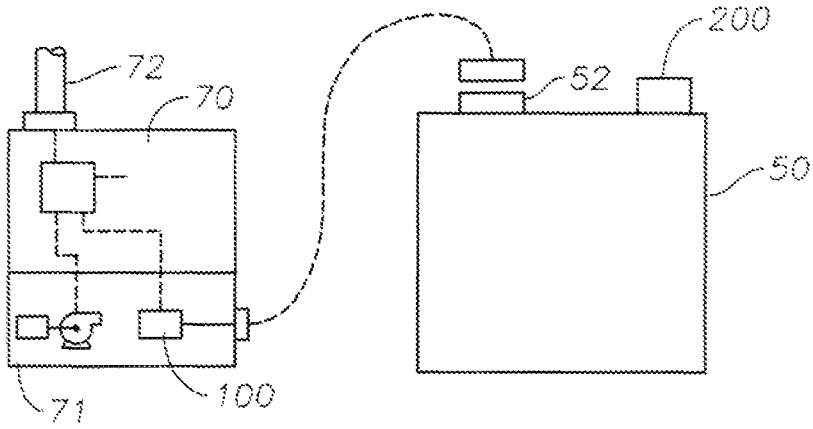
FIG. 4 is a schematic illustration of a connection between an ROV subsea electronic module (SEM) and an SEM located on the SCM in accordance with an embodiment of the invention.

In another embodiment schematically shown in FIG. 4, the hydraulic skid 71 of the ROV 70 has an SEM (Subsea Electronic Module) 100 that may receive power and electrical signals from the flying lead 72 and convert it to power and signal for the subsea tree SEM 200, which may be located on the SCM 50. A control line (not shown) communicates the SEMS 100, 200 while a power line (not shown) allows the ROV SEM 100 to supply converted power to the subtree SEM 200. A portable master control station (not shown) could also be used in the surface control room on the vessel to control the ROV 70.

The system eliminates the capital and installation cost problems associated with the traditional IWOCS system. The plumbing arrangement between the ROV hydraulic skid 71, the fixed junction 30, and the SCM 50 allows vented hydraulic fluid to be captured and repressurized for re-use in the SCM 50. Further, the proposed arrangement reduces the control fluid discharge to seawater.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A subsea well apparatus, comprising, a subsea tree having a hydraulically-operated valve; and a control module with the subsea tree;

a hydraulic line extending from the control module to the hydraulically-operated valve to operate the hydraulically-operated valve;

an input receptacle in fluid communication with the control module and in selective fluid communication with a utility skid on a remotely operated vehicle (ROV), so that hydraulic fluid from the ROV is selectively supplied to the control module;

an output receptacle in fluid communication with a hydraulic fluid return line extending from the control module and configured to direct hydraulic fluid to an external device;

a subsea tree electronic module on the subsea tree that is controlled by an ROV electronic module on the ROV by signals communicated to the subsea tree electronic module from the ROV electronic module via a control line, and by power from a power source on a vessel via an electrical line that is part of a workover umbilical that has an end connected to a hydraulic fluid source.

2. The apparatus according to claim 1, further comprising a pump located within the ROV to repressurize control fluid returning from the control module to the hydraulic return interface and circulate the repressurized fluid back thru the input receptacle.

3. A subsea well apparatus during a workover mode, comprising, a hydraulically-operated subsea valve;

a control module operably installed with a subsea tree, the control module having a hydraulic fluid line extending from the control module to the hydraulically-operated subsea valve on the subsea tree;

a junction operably installed with the subsea tree and configured to engage an external device to receive hydraulic fluid from the external device and to vent hydraulic fluid from the subsea valve to the external device;

a hydraulic fluid supply line to couple hydraulic fluid from the junction to the control module; and a hydraulic fluid return line to couple hydraulic fluid vented from the hydraulically-operated subsea valves to the junction wherein a hydraulic section of an ROV further comprises a return pairing for interface with the supply and return lines at the junction;

a workover umbilical connected at one end to a hydraulic fluid source further comprises an electrical line connected to a power source on a vessel, and connects at another end to the ROV to provide power to the control module, and wherein the electrical line further provides power and electrical signals to an electronic module located on the ROV, the electronic module converting the power and electrical signals to serve an electronic module located on the subsea tree, the electronic modules connected to each other via power and control lines.

4. A method for operating a subsea hydraulic valve of a subsea tree during workover operations, the subsea tree having a control module for operating hydraulic valves of the tree and a junction coupled by a supply line to the control module to provide hydraulic fluid to the control module, the method comprising:

connecting a workover umbilical to an ROV having a hydraulic section;

flying the ROV to the junction and coupling the hydraulic section with the hydraulic supply line and the hydraulic section with a return line;

establishing a closed hydraulic loop between the hydraulic section of the ROV and the control module;

dispensing hydraulic fluid to the control module from the ROV and venting hydraulic fluid from a subsea hydraulic valve thru the return line to the ROV; and increasing the pressure of hydraulic fluid vented from the subsea hydraulic valve to thereby recirculate hydraulic fluid to the control module.

5. The method according to claim 4, further comprising workover mode.

6. The method according to claim 4 further comprising providing power to the ROV and the subsea tree via the workover umbilical.

7. The method according to claim 4 further comprising providing power and electrical signals to the ROV and the subsea tree via the workover umbilical.

8. The method according to claim 4, wherein the pressure of the hydraulic fluid is increased by a pump located in the ROV:

wherein a junction plate has an input receptacle in fluid communication with the supply line and an output receptacle in fluid communication with the return line.

* * * * *